United States Patent [19]

Plummer

[11] Patent Number: 5,064,359

[45] Date of Patent: Nov. 12, 1991

[54] ANNULAR SUPPORT FOR A SEAL FOR A TILT PISTON

[75] Inventor: Darrill L. Plummer, Charlotte, N.C.

[73] Assignee: Ingersoll-Rand Company, Woodcliff Lake, N.J.

[21] Appl. No.: 552,988

[22] Filed: Jul. 16, 1990

[51] Int. Cl.[5] ..... F04B 07/04

[52] U.S. Cl. ..... 417/489; 277/205; 277/212 C; 92/240; 92/241; 417/553

[58] Field of Search ..... 417/484, 489, 553; 92/240, 241, 254; 277/30, 188 A, 188 R, 205, 212 C

[56] References Cited

U.S. PATENT DOCUMENTS

| | | | |
|---|---|---|---|
| 145,921 | 12/1873 | Wharton | 417/484 |
| 3,143,934 | 8/1964 | Nelson | 92/240 |
| 4,027,816 | 6/1977 | Slator et al. | 277/205 |
| 4,317,408 | 3/1982 | Williams | 92/240 |
| 4,516,481 | 5/1985 | Geffroy et al. | 92/240 |
| 4,618,153 | 10/1986 | Nillson | 277/188 A |
| 4,674,754 | 6/1987 | Lair et al. | 277/188 A |

FOREIGN PATENT DOCUMENTS

| | | | |
|---|---|---|---|
| 209088 | 5/1960 | Austria | 92/240 |
| 952552 | 11/1949 | France | 92/240 |
| 1263810 | 5/1961 | France | 92/240 |

*Primary Examiner*—Richard A. Bertsch
*Assistant Examiner*—Michael I. Kocharov
*Attorney, Agent, or Firm*—Glenn B. Foster

[57] ABSTRACT

An apparatus includes a tilt piston having a piston head. The piston head is reciprocally disposed within a cylindrical bore formed in a housing, the bore being oriented along an axis. A seal is mounted circumferentially about the piston head. The seal has an outer diameter that exceeds an inner diameter of the cylindrical bore. The seal extends radially in a first direction having an axial component. A support is mounted circumferentially of the piston head adjacent the seal. The support has an outer diameter less than the outer diameter of the seal. The seal is a continuous annular ring which may be of a circular or rectangular cross section. The seal and the support may be formed as a unitary member or may be two distinct elements. The support contacts the bore during a portion of travel of the piston within the bore.

20 Claims, 3 Drawing Sheets

5064359

ANNULAR SUPPORT FOR A SEAL FOR A TILT PISTON

BACKGROUND OF THE INVENTION

This invention relates generally to a tilt piston (also referred to as a wobble piston), such as may be used in tilt piston compressors and other applications, and more particularly to an annular support which supports a seal for the tilt piston.

Presently, tilt pistons are used in compressors of relatively light pressures and powers. The simple design of the tilt piston compressor type, the limited number of moving parts, the ease of manufacture, and the lack of oil as a lubricant gives the tilt piston design several advantages over the conventional reciprocating designs.

One of the limiting factors of this design is obtaining a piston head seal which can withstand the greater pressures, piston bore volumes and forces which the pistons are to be exposed to.

When the piston seal is exposed to pressures which exceed what they are capable of handling, the seal fails, and the sides of the tilt piston engage the piston bore, which results in great damage to the bore and the piston.

The foregoing illustrates limitations known to exist in present tilt piston head seal designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus including a tilt piston having a piston head. A radially extending support is mounted circumferentially of the piston head, the support having a first diameter terminating at a first outer circumferential surface.

A substantially radially extending seal is mounted circumferentially of the piston head adjacent the support. The seal has a second diameter greater than the first diameter, and terminating at a second outer circumferential surface. The second outer circumferential surface is displaced at an angle in a direction away from the first outer circumferential surface.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
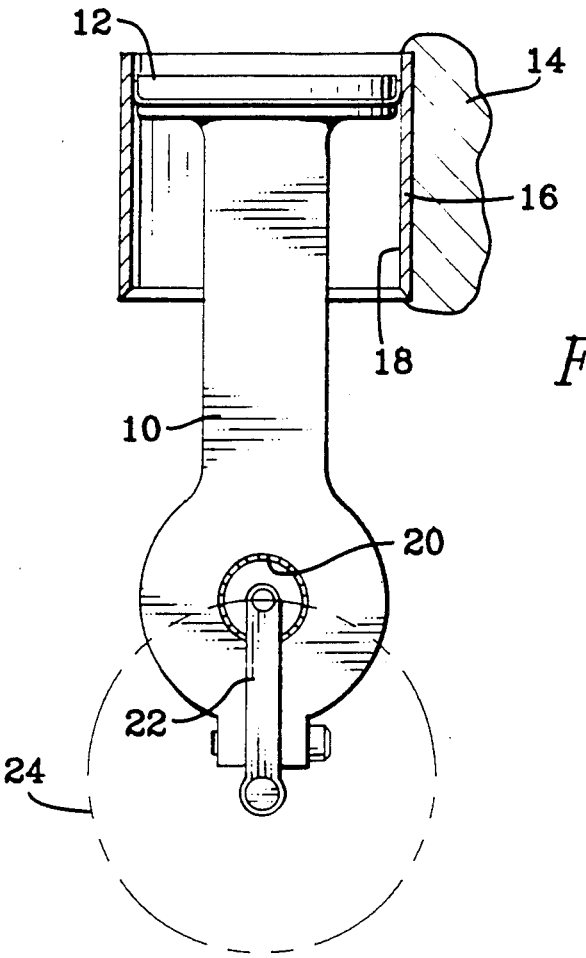
FIG. 1 (PRIOR ART)
FIG. 1 is a partial cross sectional view illustrating an embodiment of a prior art tilt piston compressor with the piston in the top dead center position.

Identical elements in prior art and the instant invention are referenced by identical reference characters.

Tilt pistons 10, which are commonly used in tilt piston compressors, are formed with a piston head 12. The piston head 12 is disposed within a bore 16 having a bore wall 18 formed in a housing 14. Examples of tilt piston compressors are U.S. Pat. No. 3,961,869 and U.S. Pat. No. 4,028,015, incorporated herein by reference.

The tilt piston has an aperture 20 in which is disposed on crank 22 which travels in a rotary path 24. The aperture 20 will follow the path 24 of the crank 22 resulting in reciprocating displacement of the piston head 12 within the bore 16.

A flexible annular seal 26 is mounted circumferentially about the piston head 12, the seal limiting a passage of fluid from between the piston head 12 and the bore wall 18. The lifetime of the seal is the determining factor in the lifetime of compressors of the tilt piston design.

The seal 26 may be formed of a plastic, elastomeric, synthetic, metallic, or any material which provides flexibility while permitting long life of the seal under loaded conditions. The product sold under the name TEFLON (a registered trademark of the DuPont Company of Wilimington, Del.) with embedded bronze material has been found especially applicable for a seal material. The seal is of an annular configuration, and is preferably formed in rectangular cross section, even though other cross sections (such as circular) may be used.

The seal, when in place around the piston head 12, extends in a first radial direction 28. The first radial direction 28 can be broken down into an axial component 30 and a radial component 32.

Since the seal 26 is directed in a first direction 28 which is angled from the radial component, the seal will be able to deflect in response to compressive loads applied between the bore wall 18 and the piston head 12, while maintaining a seal about the periphery 34 of the piston head 12.

An outer circumferential surface 25 of the seal 26 having a first diameter 27 which exceeds the diameter of the bore 16. This configuration permits sealing of the entire periphery 34 of the piston head 12 to be maintained through a limited range of angular displacement 35 during the reciprocating travel of the piston head 12 within the bore 16. In this specification, outer diameter of the seal 26 and an annular support member 52 is determined prior to assembly thereof.

To fabricate the tilt piston, an annular shoulder 36 is formed within the piston head 12. The seal 26, which is an annular member is disposed adjacent the shoulder 36, and a seal retaining ring 38 is affixed to a first wall 40 of the shoulder 36, such that the seal 26 is firmly held in position adjacent the shoulder 36.

The tilt piston 10 is then forced through a tapered recess member 42 with a minimum diameter 44 being slightly less than the first outside diameter 25 of the seal 26. As the tilt piston 10 is drawn through the tapered recess member 42 in a direction 46 (toward the minimum diameter 44), then the seal 26 will be displaced toward the first radial direction 28.

The seal 26 will have a natural tendency to return towards the first radial direction 28, and a returning force will be applied whenever the seal is deflected from this position. This spring force will tend to seal any fluid leakage between the piston head 12 and the bore 16 when the tilt piston 10 undergoes reciprocatory motion.

During faster tilt piston 10 operations, use of heavier and larger tilt pistons and use of tilt pistons which result in production of greater pressures, an excessive radial force 48 is applied between the piston head 12 and the bore 16 (beyond what is necessary to produce a seal).

This excessive radial force 48 has a tendency to compress and bend the seal 26 on one side of the piston head 12, resulting in an enlarged sealing surface area 50 between the seal 26 and the bore wall 18.

This enlarged surface area 50 results in increased wear of the seal, an increased generation of heat between the seal 26 and the bore 16, as well as more resistance to travel of the tilt piston 10 within the bore 16. All of the above have a tendency to decrease the lifetime of the seal due to wear or catastrophic failure (which limits the life of an entire compressor 13). It is therefore desired to minimize the sealing surface area 50.

The instant invention relates to the interaction of the annular support member 52 and the seal 26. The annular support means 52 is mounted circumferentially about the piston head 12 adjacent the seal 26. Both the support means 52 and the seal 26 are contained within the annular shoulder 36, and are compressed by the seal retaining ring.

The support means 52 has a second outer circumferential surface 53 with a second diameter 55, and provides support for the piston head around the entire periphery 34 of the piston head 12. The piston is typically ring shaped. The support means is typically a ring with a circular or a rectangular cross section, even though any annular configuration which provides uniform support to the seal 26 may be used. The second diameter 55, prior to assembly, is typically between that of the first diameter 27 and the bore 16.

Figure 6:
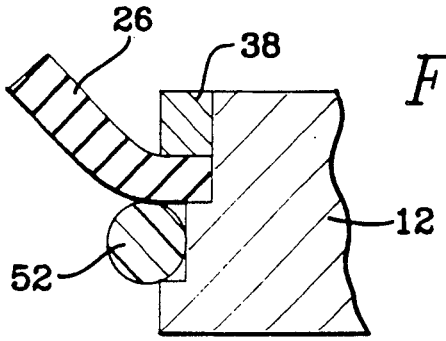
FIG. 6 is a cross sectional view illustrating a tilt piston of an alternate embodiment, the support having a circular cross sectional configuration.
Figure 7:
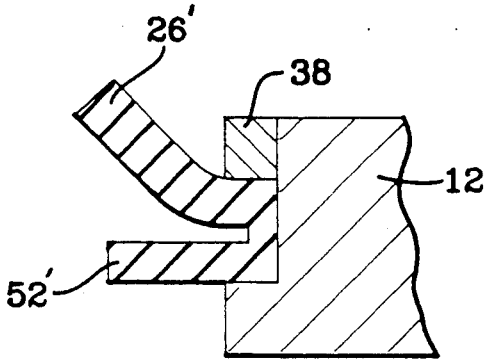
FIG. 7 is a view similar to FIG. 6, with the support member and the seal formed from a unitary member.

The support means 52 and the seal 26 are typically constructed as two separate members, as shown in FIG. 6. Alternately, these two members may be formed as a unitary element 53 containing support means portion 52' and seal portion 26' as shown in FIG. 7. In both designs, the outer diameter 54 of the support means 52 will equal or exceed the inner diameter 56 of the bore 16.

Figure 2:
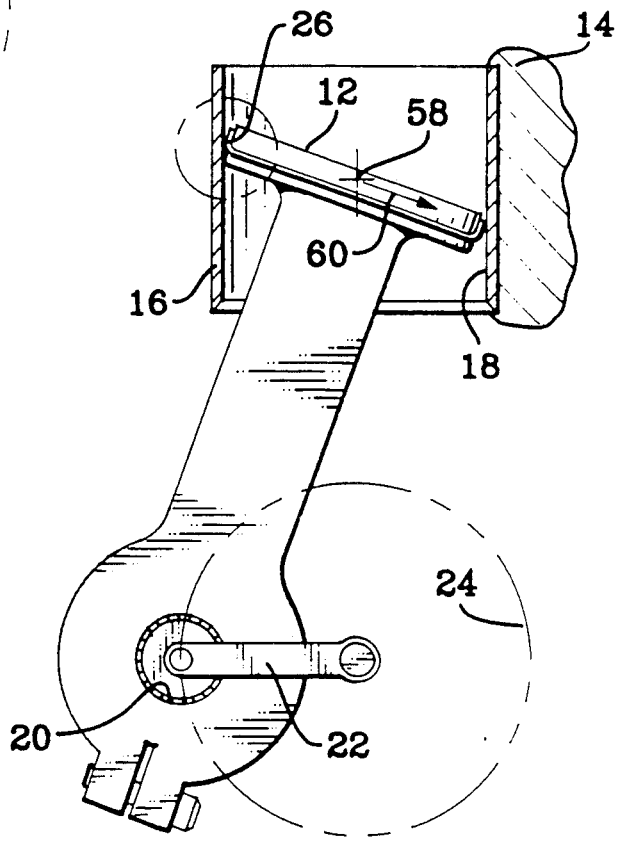
FIG. 2 (PRIOR ART)
FIG. 2 is a view similar to FIG. 1, with the piston in a median position.
Figure 3:
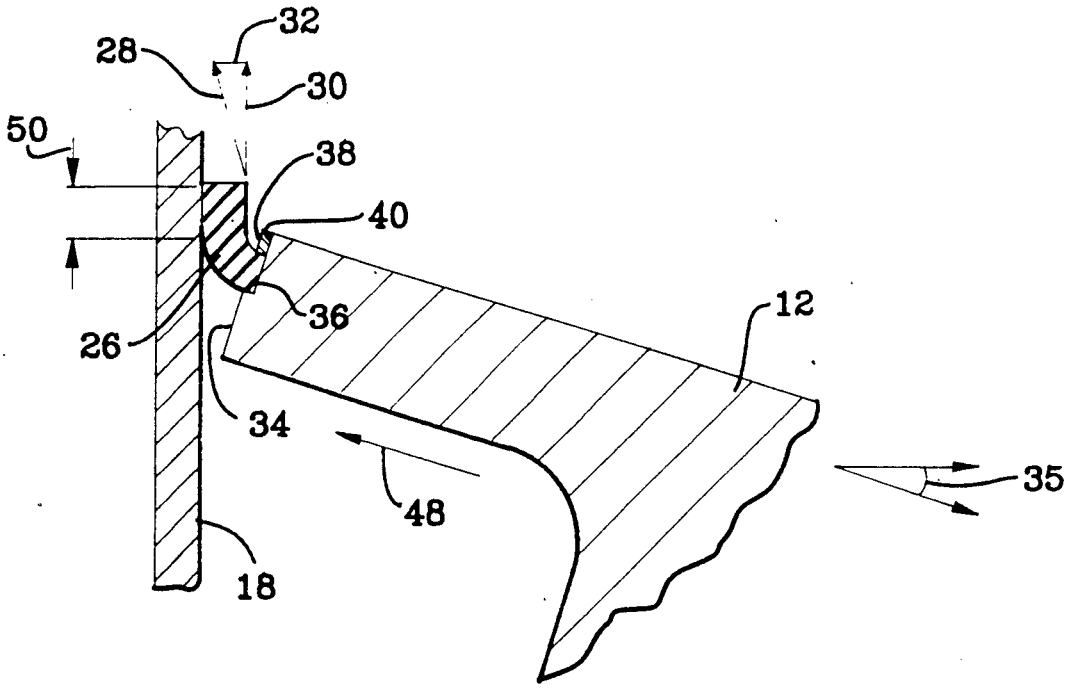
FIG. 3 (PRIOR ART)
FIG. 3 is a cross sectional view of the encircled portion of the prior art tilt piston illustrated in FIG. 2.
Figure 4:
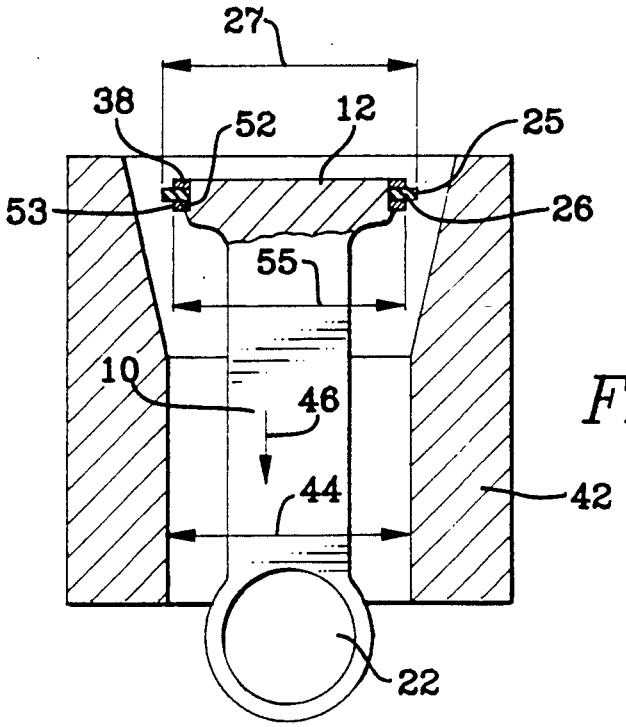
FIG. 4 is a partial cross sectional view illustrating a tilt piston of the instant invention which is about to be drawn through a tapered recess member 42 to position the seal with respect to the piston head.
Figure 5:
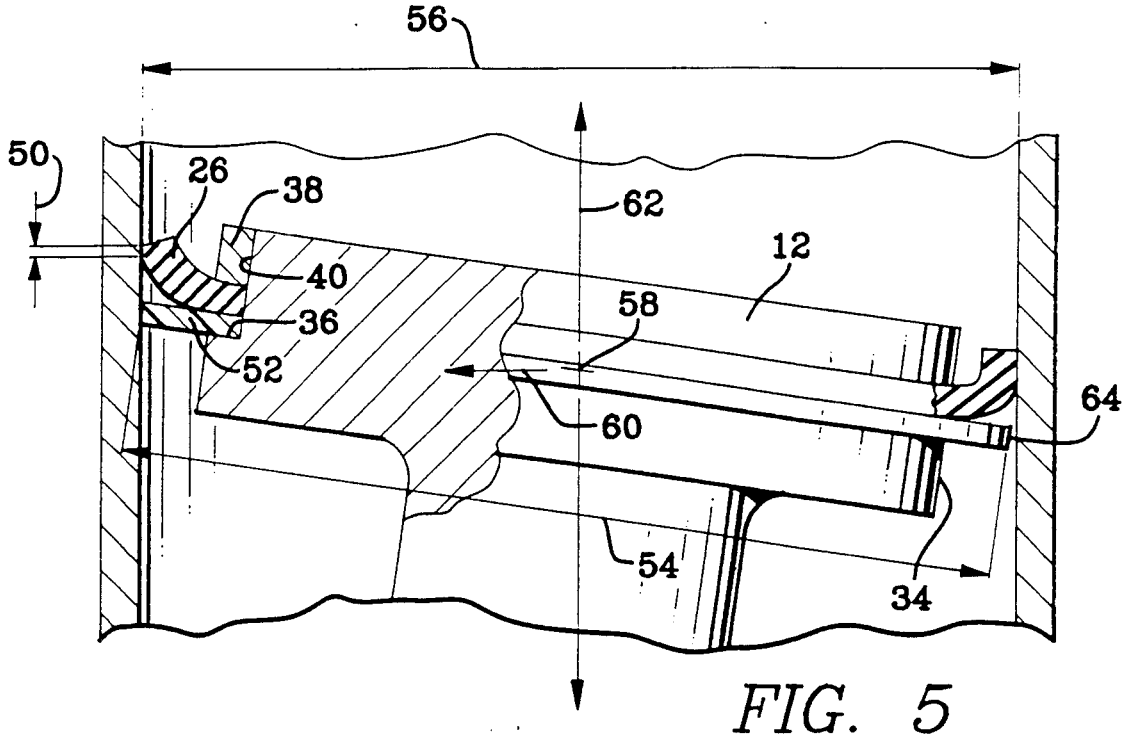
FIG. 5 is a partial cross section and partial elevation view illustrating one embodiment of the tilt piston of the instant invention, with the piston angled the maximum amount about a tilt axis.

As illustrated in FIGS. 1, 2 and 5, when the tilt piston reciprocates within the bore 16, and the aperture 20 follows the rotary path 24 of the crank 22, the piston head 12 will tilt about a tilt axis 58. The non-tilt axis 60 of the piston head will remain parallel as the piston head reciprocates within the bore.

Both the seal 26 and the support means 52, which intersect the tilt axis 58, will maintain contact with the wall of the bore 18 (at the center line 62 of the bore) during each point of reciprocal travel of the piston head 12. This contact will prevent the tilt axis 58 of the piston head 12 from being laterally displaced from the center line 62 regardless of how much the piston head tilts about the tilt axis 58.

Since the tilt axis of the piston 58 will remain centered in the bore 16, the seal will not be compressed against the side of the bore at any point around the periphery of the piston head 12 resulting in the above described limitations in piston life. Due to angling of the tilt piston head about a tilt axis, a section 64 of the support means 52 which intersects the non-tilt axis 60 may lose contact with the wall of the bore 18 when the piston head 12 is at its tilt limit about the tilt axis 58.

The support means 52 may be constructed from the same material as the seal 26. However, there is no necessity for the support means to be flexible as is the case with the seal (the seal must be deformed when it is angled towards the first radial direction 28). Plastics, metals or elastomers may be suitable to construct the support means 52. TEFLON, with bronze embedded for wear characteristics has been found especially applicable.

Having described the invention, what is claimed is:

1. A tilt piston reciprocally disposed within a bore formed within a housing, the tilt piston comprising:
   - a piston head;
   - a radially extending support mounted circumferentially of the piston head, the support having a first diameter terminating at a first outer circumferential surface, the first outer circumferential surface having an initial diameter equal to or greater than said bore; and
   - a substantially radially extending seal mounted circumferentially of the piston head and adjacent the support, the seal having a second diameter greater than the first diameter and terminating at a second outer circumferential surface, the second outer circumferential surface being displaced at an angle in a direction away from the first outer circumferential surface.

2. The apparatus as described in claim 1, wherein the support is an annular ring.

3. The apparatus as described in claim 2, wherein the annular ring has a circular cross section.

4. The apparatus as described in claim 2, wherein the annular ring has a rectangular cross section.

5. The apparatus as described in claim 1, wherein the seal and the support are separate members.

6. The apparatus as described in claim 1, wherein the seal and the support are formed as a unitary member.

7. The apparatus as described in claim 1, wherein the tilt piston is mounted for reciprocating travel within a bore.

8. The apparatus as described in claim 1, wherein the support restricts excessive deflection of the seal.

9. An apparatus comprising:
   - a tilt piston having a piston head, the piston head being reciprocally disposed within a cylindrical bore formed within a housing, the bore being oriented along an axis;
   - a seal having a diameter and being mounted circumferentially about said piston head, the seal having an outer diameter that exceeds an inner diameter of the cylindrical bore, the seal extending radially in a first direction having an axial component; and
   - support means mounted circumferentially about the piston head adjacent the seal, the support means having a diameter less than the diameter of the seal, a diameter of the support means being greater than a diameter of the bore, and the support means provides radial resistance to loads applied from the piston head to the bore, thereby reducing deformation of the seal.

10. The apparatus as described in claim 9, wherein the seal and the support means are separate members.

11. The apparatus as described in claim 9, wherein the seal and the support means are a unitary member.

12. The apparatus as described in claim 9, wherein the seal and the support means will both contact the bore during a portion of piston travel within the bore.

13. The apparatus as described in claim 9, wherein at least a portion of both the seal and the support means continually contact the wall of the bore during reciprocation of the piston head within the bore.

14. The apparatus as described in claim 9, wherein a sealing surface area between the seal and the bore, during displacement of the tilt piston, is minimized due to the support means preventing compression of the seal.

15. An apparatus comprising:

a tilt piston having a piston head, the piston head being reciprocally disposed within a cylindrical bore formed in a housing, the bore being oriented along an axis;

seal means having a diameter and being mounted circumferentially about said piston head for limiting a leakage of fluid between a periphery of the piston and the bore; and support means mounted circumferentially of the piston head adjacent the seal, the support means having an external diameter less than the original external diameter of the seal, but greater than an internal diameter of said bore, the support means providing radial resistance to loads applied from the piston head to the bore, and thereby reduces deformation of the seal.

16. The apparatus as described in claim 15, wherein the seal means and the support means are separate members.

17. The apparatus as described in claim 15, wherein the seal means and the support means are a unitary member.

18. The apparatus as described in claim 15, wherein the seal means and the support means will both contact the bore during a portion of piston travel within the bore.

19. The apparatus as described in claim 15, wherein at least a portion of both the seal means and the support means contact the wall of the bore during each point of reciprocation of the piston head within the bore.

20. The apparatus as described in claim 15, wherein a sealing surface area between the seal means and the bore, during displacement of the tilt piston, is minimized due to the support means preventing compression of the seal means.

* * * * *